US010267554B2

(12) United States Patent
Reuter et al.

(10) Patent No.: US 10,267,554 B2
(45) Date of Patent: Apr. 23, 2019

(54) MULLION FOR A REFRIGERATOR APPLIANCE

(71) Applicant: Haier US Appliance Solutions, Inc., Wilmington, DE (US)

(72) Inventors: Daryl Lee Reuter, Evansville, IN (US); Brian Culley, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/673,450

(22) Filed: Aug. 10, 2017

(65) Prior Publication Data

US 2019/0049170 A1 Feb. 14, 2019

(51) Int. Cl.
*F25D 23/02* (2006.01)
*F25D 11/02* (2006.01)

(52) U.S. Cl.
CPC ..... *F25D 23/028* (2013.01); *F25D 11/02* (2013.01); *F25D 23/02* (2013.01); *F25D 2323/021* (2013.01)

(58) Field of Classification Search
CPC ..... F25D 2323/021; F25D 2323/024; F25D 23/02; F25D 23/028; Y10T 16/5383; Y10T 16/5384; Y10T 16/53848; Y10T 16/53822; Y10T 16/53826
See application file for complete search history.

(56) References Cited

U.S. PATENT DOCUMENTS 743,747 A * 11/1903 Nevelson ..... E05F 1/1284 16/293
2,812,539 A * 11/1957 Lundell ..... E05F 1/1284 16/293
3,785,006 A * 1/1974 Metz ..... E05F 1/1284 16/293
4,477,941 A * 10/1984 Gregg ..... E05D 1/00 16/289
4,711,098 A 12/1987 Kawabara et al.
4,971,382 A * 11/1990 Ohno ..... B60K 15/05 16/291
5,694,789 A * 12/1997 Do ..... F25D 23/02 312/405
7,008,032 B2 3/2006 Chekal et al.
8,167,389 B2 5/2012 Han et al.
8,292,383 B2 10/2012 Laible
9,127,876 B2 9/2015 Wilson et al.
9,134,062 B2 9/2015 Jung et al.
9,163,870 B2 10/2015 Jeon et al.
(Continued)

FOREIGN PATENT DOCUMENTS

DE 102011075712 A1 * 11/2012 ..... F25D 23/028
EP 2672209 A1 12/2013
(Continued)

*Primary Examiner* — Andrew M Roersma
(74) *Attorney, Agent, or Firm* — Dority & Manning, P.A.

(57) ABSTRACT

A refrigerator appliance includes a cabinet defining a chamber and a door coupled to the cabinet. The door is rotatable between a closed position and an open position to selectively sealingly enclose the chamber. The refrigerator appliance also includes a mullion rotatably coupled to the door via a hinge. The mullion is rotatable between a first position and a second position. The hinge includes a pivot member and a biasing element configured to retain the mullion in the first position and the second position.

8 Claims, 8 Drawing Sheets

(56) References Cited

U.S. PATENT DOCUMENTS

| | | | | |
|---|---|---|---|---|
| 9,188,382 | B2 | 11/2015 | Kim et al. | |
| 9,234,695 | B1 | 1/2016 | Dubina et al. | |
| 2009/0273264 | A1* | 11/2009 | Butler | F25D 23/028 312/405 |
| 2015/0015133 | A1 | 1/2015 | Carbajal et al. | |
| 2016/0003521 | A1 | 1/2016 | Jeon et al. | |

FOREIGN PATENT DOCUMENTS

| | | | | | |
|---|---|---|---|---|---|
| JP | 2004353943 | A | * | 12/2004 | F25D 23/028 |
| JP | 2014020572 | A | * | 2/2014 | F25D 23/02 |
| WO | WO-2015017990 | A1 | * | 2/2015 | F25D 23/02 |
| WO | WO-2015162894 | A1 | * | 10/2015 | F25D 23/02 |

* cited by examiner

MULLION FOR A REFRIGERATOR APPLIANCE

FIELD OF THE INVENTION

The present disclosure is related generally to refrigerator appliances and more particularly to mullions for refrigerator appliances.

BACKGROUND OF THE INVENTION

Refrigerator appliances generally include one or more food compartments, e.g., a fresh food compartment and/or freezer compartment, to maintain foods at low temperatures. The fresh food compartment or freezer compartment of a refrigerator is typically accessible through an opening. Access to the opening may be provided by one or more doors connected by hinges to the rest of the appliance. Refrigerator appliances typically include sealing elements to avoid or minimize energy losses, e.g., to prevent ambient air from leaking into the appliance and cold air from leaking out of the appliance. Such sealing elements may be configured to interact or cooperate with the door(s) of the refrigerator appliance to retain cold air within the freezer and fresh food compartments while still allowing the user to easily access articles, e.g., food items, stored in the one or more food compartments.

Sealing elements may include gaskets which interact with the door(s) in order to seal the door(s) against the refrigerator cabinet when the door(s) is/are closed. Some refrigerator appliances include two rotatably mounted opposing doors for access to a single opening, e.g., at the fresh food compartment. Such door configurations are generally referred to as French doors. French doors are desirable because they reduce the weight load on the door hinge. French doors divide the corresponding opening in two, such that each door weighs less than a single door would weigh. The relatively reduced weight of each individual door in a French door configuration allows the size of the support structure of each door to be reduced. French doors also increase accessibility to the refrigerator cabinet and provide additional storage arrangements that are not possible with a single-door design.

However, French doors require additional seals; in particular, the middle of the refrigerator opening where the two doors meet must maintain a seal when the doors are closed. Accordingly, some French door refrigerators include a stationary vertical mullion bar in the middle of the corresponding opening, and each door may sealingly engage the mullion. A stationary mullion limits the size of items that can be put into the refrigerator. Some French door refrigerators include a movable mullion attached to one of the doors such that access to the corresponding compartment via the respective opening is not obstructed by the mullion when the door to which the mullion is attached is opened. However, in some instances, the movable mullion may become misaligned and as a result may impair the sealing engagement of the doors or may inhibit the doors from opening or closing.

Accordingly, improved mullions for use in refrigerator appliances that address one or more of the challenges described above would be beneficial.

BRIEF DESCRIPTION OF THE INVENTION

Aspects and advantages of the invention will be set forth in part in the following description, or may be apparent from the description, or may be learned through practice of the invention.

In one exemplary aspect, a refrigerator appliance provided. The refrigerator appliance defines a vertical direction, a lateral direction, and a transverse direction. The vertical, lateral, and transverse directions are mutually perpendicular. The refrigerator appliance includes a cabinet defining a chamber and a door coupled to the cabinet. The door is rotatable between a closed position and an open position to selectively sealingly enclose the chamber. The refrigerator appliance also includes a mullion rotatably coupled to the door via a hinge. The mullion is rotatable between a first position and a second position. The hinge includes a pivot member and a biasing element configured to retain the mullion in the first position and the second position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
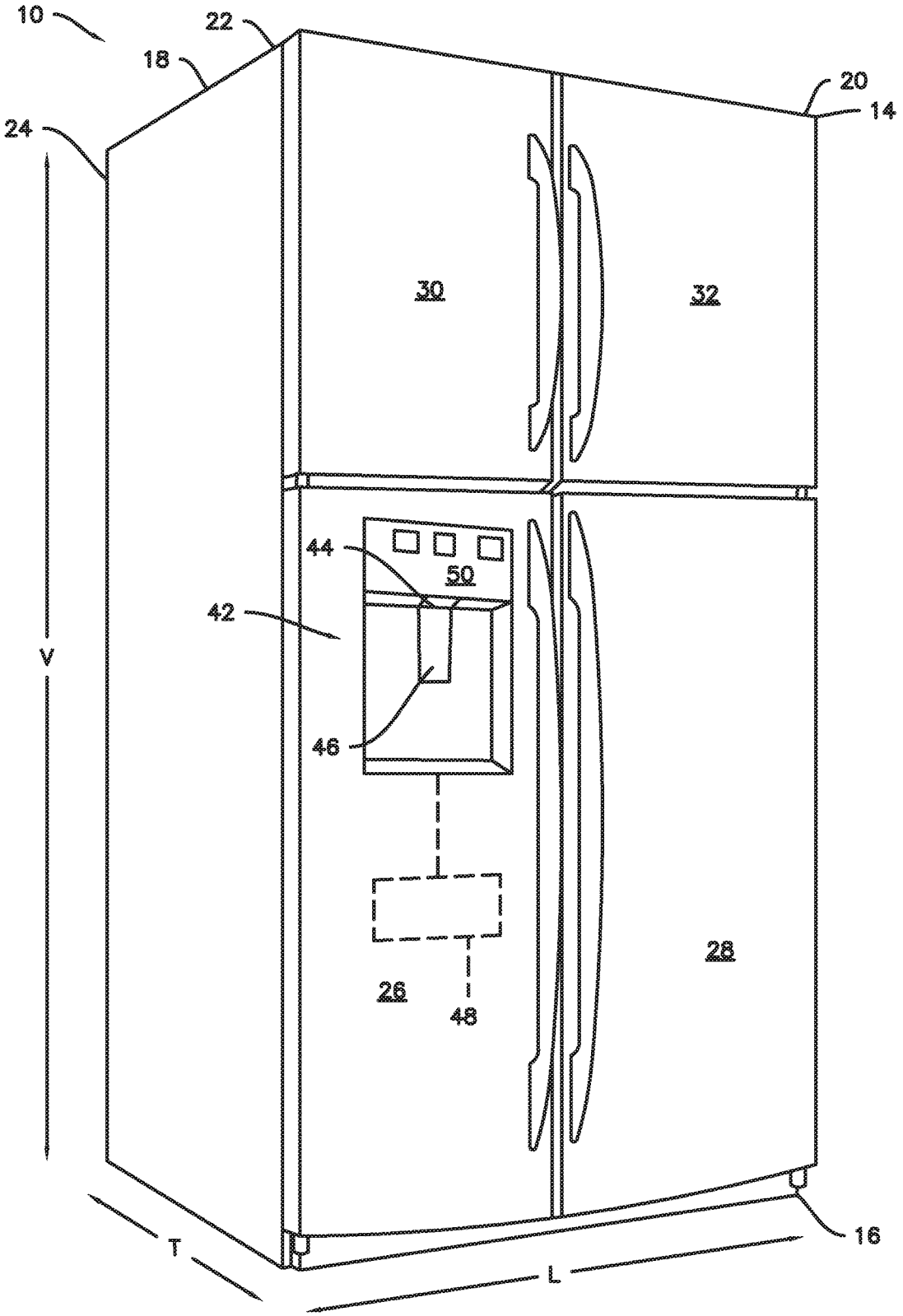
FIG. 1 provides a perspective view of a refrigerator appliance according to an exemplary embodiment of the present subject matter with the doors shown in the closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

FIG. 1 provides a perspective view of a refrigerator appliance 10 according to an exemplary embodiment of the present subject matter. Refrigerator appliance 10 defines a vertical direction V, a lateral direction L, and a transverse direction T, the vertical direction V, the lateral direction L, and the transverse direction T are mutually perpendicular. Refrigerator appliance 10 includes a housing or cabinet 12 that extends between a top 14 and a bottom 16 along the vertical direction V, between a left side 18 and a right side 20 along the lateral direction L, and between a front side 22 and a rear side 24 along the transverse direction T. Cabinet 12 defines at least one food storage chamber, e.g., as may be seen in FIG. 2, exemplary refrigerator appliance 10 may include a first food storage chamber 34 and a second food storage chamber 36. As depicted, the first and second food storage chambers 34, 36 are chilled chambers defined in the cabinet 12 for receipt of food items for storage. In some embodiments, cabinet 12 defines fresh food chamber 34 positioned at or adjacent bottom 16 of cabinet 12 and a frozen food storage chamber 36 arranged at or adjacent top 14 of cabinet 12. The illustrated exemplary refrigerator appliance 10 is generally referred to as a top mount refrigerator. It is recognized, however, that the benefits of the present disclosure apply to other types and styles of refrigerators such as, for example, a bottom mount refrigerator, a side-by-side style refrigerator, or a freezer appliance. Consequently, the description set forth herein is for illustrative purposes only and is not intended to be limiting in any aspect to a particular refrigerator chamber configuration.

Refrigerator doors 26 and 28 are rotatably mounted to cabinet 12, e.g., such that the doors permit selective access to fresh food storage chamber 34 of cabinet 12. Refrigerator doors 26 and 28 may be rotatable between a closed position (FIG. 1) and an open position (FIG. 2) to selectively sealingly enclose the chamber 34. As shown in the illustrated embodiments, refrigerator doors include a left refrigerator door 26 rotatably mounted to cabinet 12 at left side 18 of cabinet 12 and a right refrigerator door 28 rotatably mounted to cabinet 12 at right side 20 of cabinet 12. In embodiments including a pair of doors such as left refrigerator door 26 and right refrigerator door 28, e.g., sometimes referred to as French doors, a mullion 38 may be connected to one of the doors, e.g., left refrigerator door 26 as illustrated for example in FIG. 2. In the illustrated example, when left refrigerator door 26 and right refrigerator door 28 are in the closed position, the mullion 38 will sealingly engage the right refrigerator door 28 to increase sealing of the gap G (FIG. 4) between the left refrigerator door 26 and the right refrigerator door 28.

Figure 2:
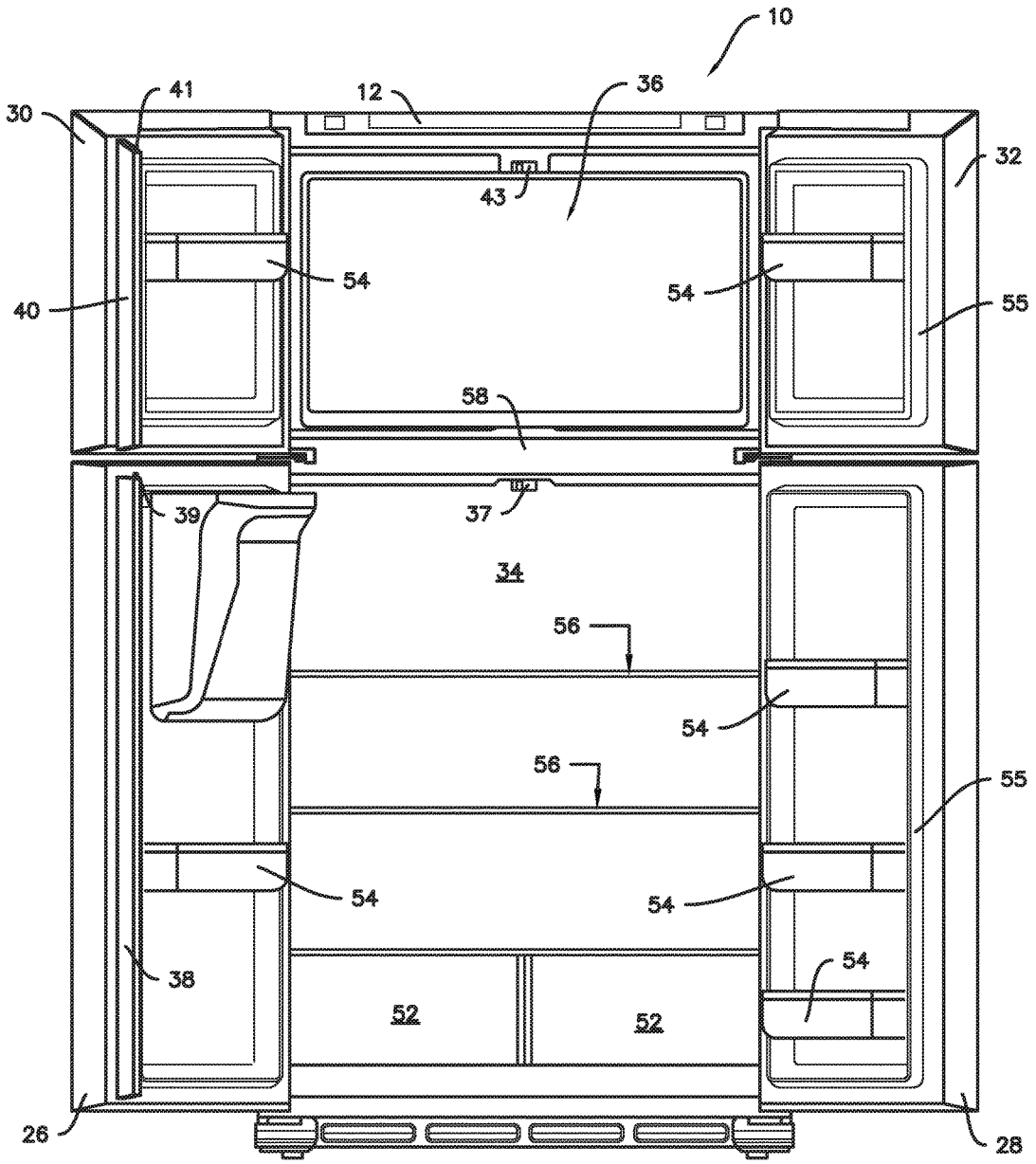
FIG. 2 provides a front elevation view of the exemplary refrigerator appliance of FIG. 1 with the doors of the exemplary refrigerator appliance shown in an open position.

Refrigerator doors 26 and 28 may be rotatably hinged to an edge of cabinet 12 for selectively accessing fresh food storage chamber 34. Similarly, freezer doors 30 and 32 may be rotatably hinged to an edge of cabinet 12 for selectively accessing frozen food storage chamber 36. To prevent leakage of cool air freezer doors 30 and 32 and/or cabinet 12 may define one or more sealing mechanisms (e.g., rubber gaskets, not shown) at the interface where the doors 30 and 32 meet cabinet 12. Such sealing mechanisms may include a mullion 40, similar to mullion 38 described above with respect to the refrigerator doors 26 and 28, in embodiments where a pair of freezer doors, e.g., a left freezer door 30 and a right freezer door 32 as illustrated in FIG. 2, are provided. Refrigerator doors 26, 28 and freezer doors 30, 32 are shown in the closed position in FIG. 1 and in the open position in FIG. 2. It should be appreciated that doors having a different style, location, or configuration are possible and within the scope of the present subject matter.

As will be described in more detail below, the refrigerator appliance may include one or more articulating mullions, e.g., mullion 38 and/or mullion 40, as described above, may be rotatable relative to a corresponding door, 26, 28, 30, or 32. For example, as illustrated in FIG. 1, embodiments of the refrigerator appliance 10 may include a left refrigerator door 26 and a right refrigerator door 28 as well as a left freezer door 30 and a right freezer door 32, e.g., two pairs of French doors, which may sometimes be referred to as a quad door configuration. One or both pairs of doors 26, 28 and/or 30, 32 may be provided with an articulating mullion 38 and/or 40.

As further shown in FIG. 2, refrigerator appliance 10 includes at least one stationary mullion. Mullions generally divide the various chambers of refrigerator appliance 10 and/or prevent leakage therefrom. For this embodiment, refrigerator appliance 10 includes a stationary mullion 58 disposed between and separating fresh food chamber 34 and freezer chamber 36. Stationary mullion 58 generally extends along the lateral direction L between left side 18 of cabinet 12 and right side 20 of cabinet 12 and generally extends along the vertical direction V to separate the chambers 34, 36 of refrigerator appliance 10. Moreover, although not shown in FIG. 2, stationary mullion 58 generally extends along the transverse direction T approximately the depth of the chambers 34, 36.

FIG. 2 provides a front view of refrigerator appliance 10 with refrigerator doors 26, 28 and freezer doors 30, 32 shown in an open position. According to the illustrated embodiment, various storage components are mounted within fresh food chamber 34 and freezer chamber 36 to facilitate storage of food items therein as will be understood by those skilled in the art. In particular, the storage components include drawers 52, bins 54, and shelves 56 that are mounted within fresh food storage chamber 34 or frozen food storage chamber 36. Drawers 52, bins 54, and shelves 56 are configured for receipt of food items (e.g., beverages and/or solid food items) and may assist with organizing such food items. As an example, drawers 52 of fresh food chamber 34 can receive fresh food items (e.g., vegetables, fruits, and/or cheeses) and increase the useful life of such fresh food items.

As illustrated in FIG. 1, refrigerator appliance 10 may also include a dispensing assembly 42 for dispensing liquid water and/or ice. Dispensing assembly 42 may be positioned on or mounted to an exterior portion of refrigerator appliance 10, e.g., on one of refrigerator doors 26 or 28. Dispensing assembly 42 includes a discharging outlet 44 for accessing ice and liquid water. An actuating mechanism 46, shown as a paddle, is mounted below discharging outlet 44 for operating dispensing assembly 42. In alternative exemplary embodiments, any suitable actuating mechanism may be used to operate dispensing assembly 42. For example, dispensing assembly 42 can include a sensor (such as an ultrasonic sensor) or a button rather than the paddle. A control panel 50 is provided for controlling the mode of operation. For example, control panel 50 includes a plurality of user inputs (not labeled), such as a water dispensing button and an ice-dispensing button, for selecting a desired mode of operation such as crushed or non-crushed ice.

Refrigerator appliance 10 further includes a controller 48. Operation of the refrigerator appliance 10 is regulated by controller 48 that is operatively coupled to control panel 50. In some exemplary embodiments, control panel 50 may represent a general purpose I/O ("GPIO") device or functional block. In some exemplary embodiments, control panel 50 may include input components, such as one or more of a variety of electrical, mechanical or electro-mechanical input devices including rotary dials, push buttons, touch pads, and touch screens. Control panel 50 can be communicatively coupled with controller 48 via one or more signal lines or shared communication busses. Control panel 50 provides selections for user manipulation of the operation of refrigerator appliance 10. In response to user manipulation of the control panel 50, controller 48 operates various components of refrigerator appliance 10. For example, controller 48 is operatively coupled or in communication with various components of a sealed refrigeration system, e.g., to set or adjust temperatures within the cabinet 12, such as within the fresh food storage chamber 34. Controller 48 may also be communicatively coupled with a variety of sensors, such as, for example, chamber temperature sensors or ambient temperature sensors. Controller 48 may receive signals from these temperature sensors that correspond to the temperature of an atmosphere or air within their respective locations.

Controller 48 includes memory and one or more processing devices such as microprocessors, CPUs or the like, such as general or special purpose microprocessors operable to execute programming instructions or micro-control code associated with operation of refrigerator appliance 10. The memory can represent random access memory such as DRAM, or read only memory such as ROM or FLASH. The processor executes programming instructions stored in the memory. The memory can be a separate component from the processor or can be included onboard within the processor. Alternatively, controller 48 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
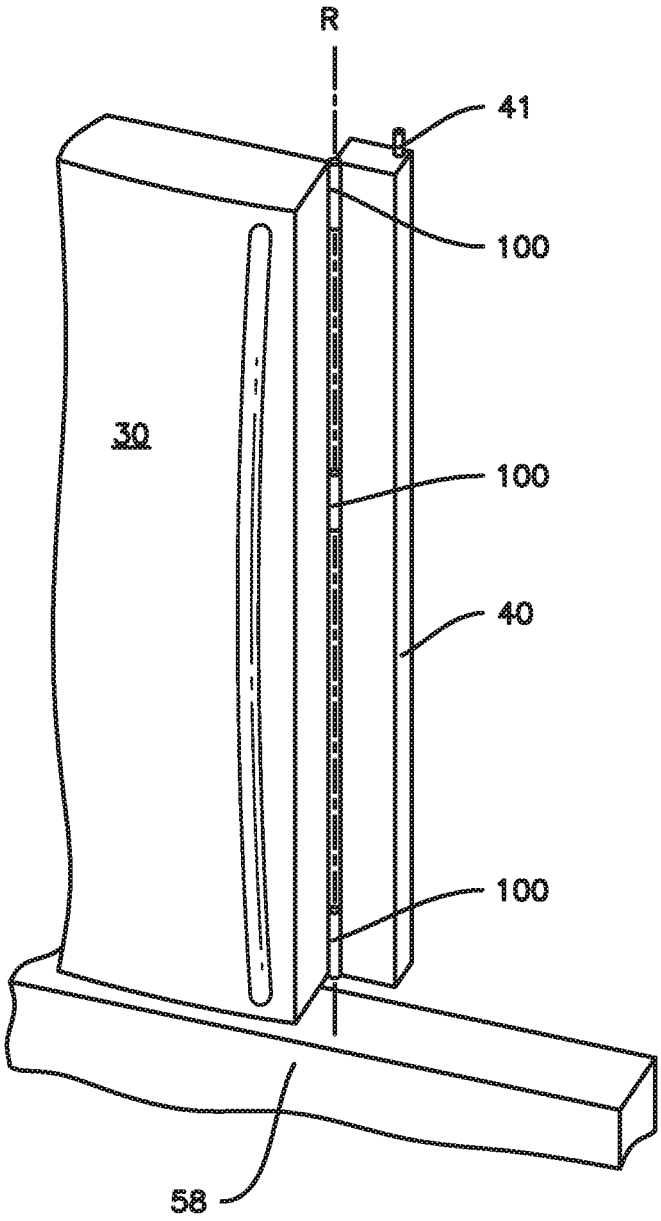
FIG. 3 provides a perspective view of a door, a stationary mullion, and an articulating mullion connected to the door of the refrigerator appliance of FIG. 1.

FIG. 3 provides a perspective view of door 30, stationary mullion 58, and articulating mullion 40 connected to door 30. As shown in FIG. 3, articulating mullion 40 can be rotatably coupled or rotatably hinged, via hinges 100, to door 30. Articulating mullion 40 can be rotated or articulated about a vertical axis of rotation R, which extends along the vertical direction V through hinges 100 as shown. Articulating mullion 40 may be rotatable about hinges 100 between a first position and a second position. Articulating mullion 40 can include additional hinges 100 or hinge components thereof in some exemplary embodiments. Moreover, articulating mullion 38 may, in various embodiments, include hinges similar to those shown and described with respect to mullion 40. Further, it should be understood that examples illustrated and described herein with respect to either one of mullion 38 or mullion 40 are equally applicable to the other of mullion 38 or mullion 40. Thus, in various embodiments, refrigerator appliance 10 may include one or both sets of French doors 26, 28 and/or 30, 32, with one or both of mullion 38 or mullion 40 associated with a respective one of the doors 26, 28, 30, or 32, and either mullion 38 or mullion 40 may include various combinations of any or all of the features shown and described herein with respect to either mullion 38 or mullion 40.

In the example embodiment of FIG. 3, articulating mullion 40 includes a tab 41 extending from the mullion 40. For this exemplary embodiment, tab 41 extends from a top portion of the mullion 40. In some embodiments, tab 41 can extend from a bottom portion of the mullion 40. In yet other embodiments, mullion 40 can include tabs 41 extending from both a top portion and a bottom portion. Tab 41 may be sized and shaped to fit within and interact with a groove 43 defined in cabinet 12 of refrigerator appliance 10 (FIG. 2). For example, groove 43 may include cam surfaces that may interact with tab 41 to cause rotation of articulating mullion 40 when door 26 is rotated from a closed to open position or vice versa. As generally shown in FIG. 2, mullion 38 may also include a tab 39 which interacts with a groove 37, and may include similar details a described above and shown in FIG. 3 with respect to the structure and function of the tab 41 and groove 43 of mullion 40. Additionally, in other embodiments, the tab, e.g., tab 41 and/or 39, may be provided on the cabinet 12 while the groove, e.g., groove 37 and/or 43, may be provided on a corresponding mullion, e.g., mullion 38 or 40.

Figure 4:
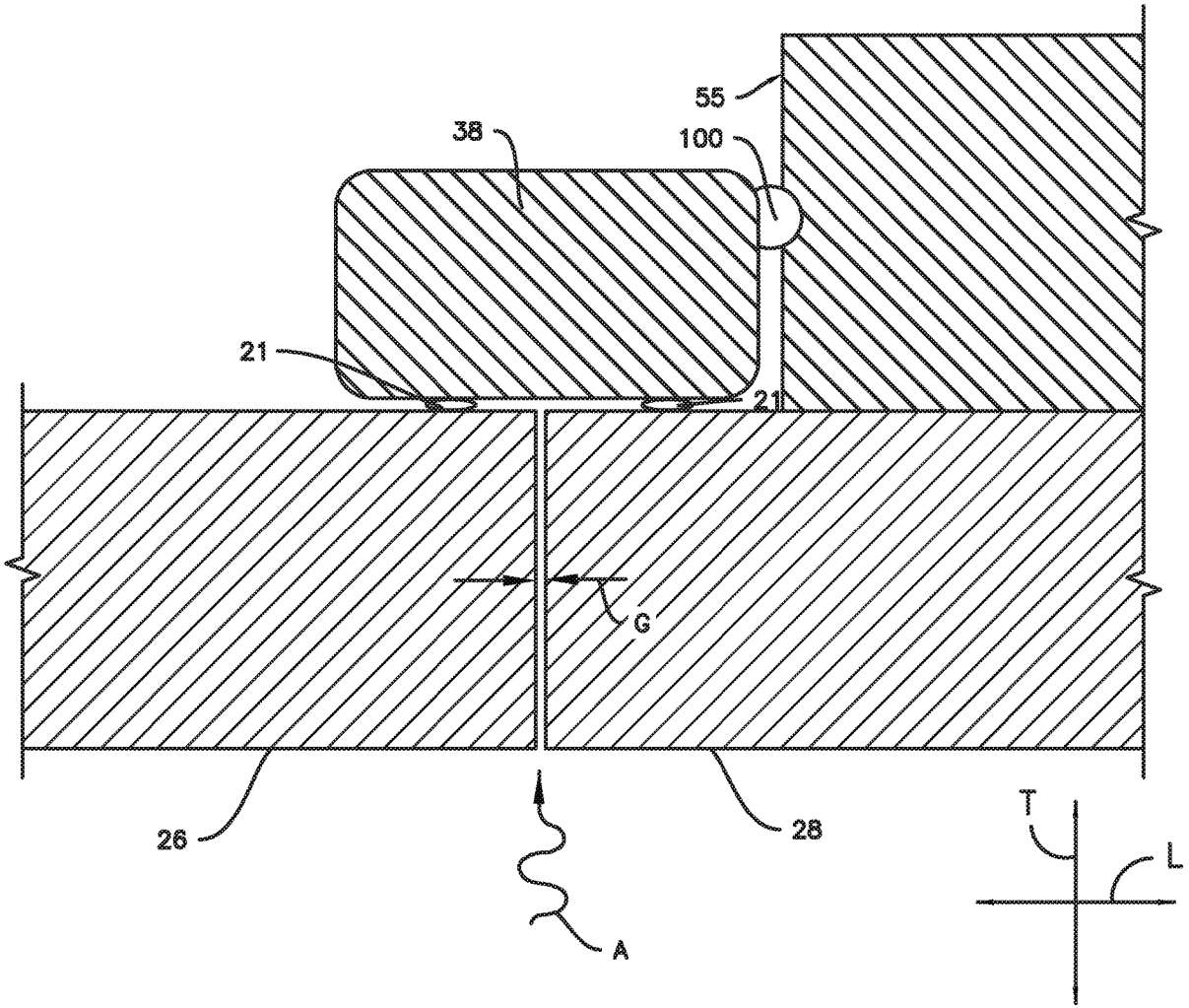
FIG. 4 provides a sectional view of doors of an exemplary refrigerator appliance in a closed position and contacting an exemplary articulating mullion according to an exemplary embodiment of the present disclosure.

FIG. 4 provides a close-up, sectional view of doors 26, 28 of exemplary refrigerator appliance 10 in a closed position and contacting articulating mullion 38 according to an exemplary embodiment of the present disclosure. For this embodiment, articulating mullion 38 is rotatably coupled or hinged to door 28 via hinge 100. In the illustrated example, the storage bins 54 (FIG. 2) are secured to and supported on each respective door 26, 28, 30, and 32 via a structural wall 55 defined on an inner surface of each respective door. Further, as shown in FIG. 4, articulating mullion 38 is connected to structural wall 55 defined on an inner surface of door 28. As noted above, various combinations of the foregoing features are possible, such as but not limited to the articulating mullion 38 may be connected to a structural wall of door 26 and/or articulating mullion 40 may be connected to a structural wall on door 30 or door 32. Moreover, in some embodiments the hinge 100 may be coupled to the inner surface of the corresponding door, e.g., proximate to one of the gaskets 21.

As shown in FIG. 4, when doors 26, 28 are in a closed position, articulating mullion 38 is generally positioned between doors 26, 28 along the lateral direction L and behind doors 26, 28 along the transverse direction T. Accordingly, articulating mullion 38 may prevent leakage between doors 26, 28. More specifically, when doors 26, 28 are in a closed position, a gap G is defined between doors 26, 28. Ambient air A, which is generally warm relative to the cooled or chilled air of chambers 34 and 36 of refrigerator appliance 10, flows through gap G and contacts articulating mullion 38. As articulating mullion 38 is positioned to block the airflow through gap G, articulating mullion 38 prevents relatively warm ambient air A from leaking into refrigerator appliance 10. Articulating mullion 38 also prevents cooled or chilled air from flowing out of refrigerator appliance 10. To prevent such leakage, inner surfaces of each door 26, 28, or gaskets 21 along such inner surfaces, contact the articulating mullion 38 and are in sealing engagement with articulating mullion 38.

Articulating mullion 38 or 40 defines a cross-sectional shape. In the illustrated embodiment, e.g., in FIG. 4, mullion 38 defines a generally rectangular cross-sectional shape. It will be appreciated that mullions 38 or 40 can have any suitable cross-sectional shape, such as a circular, oval, or polygonal cross-sectional shape.

Figure 5:
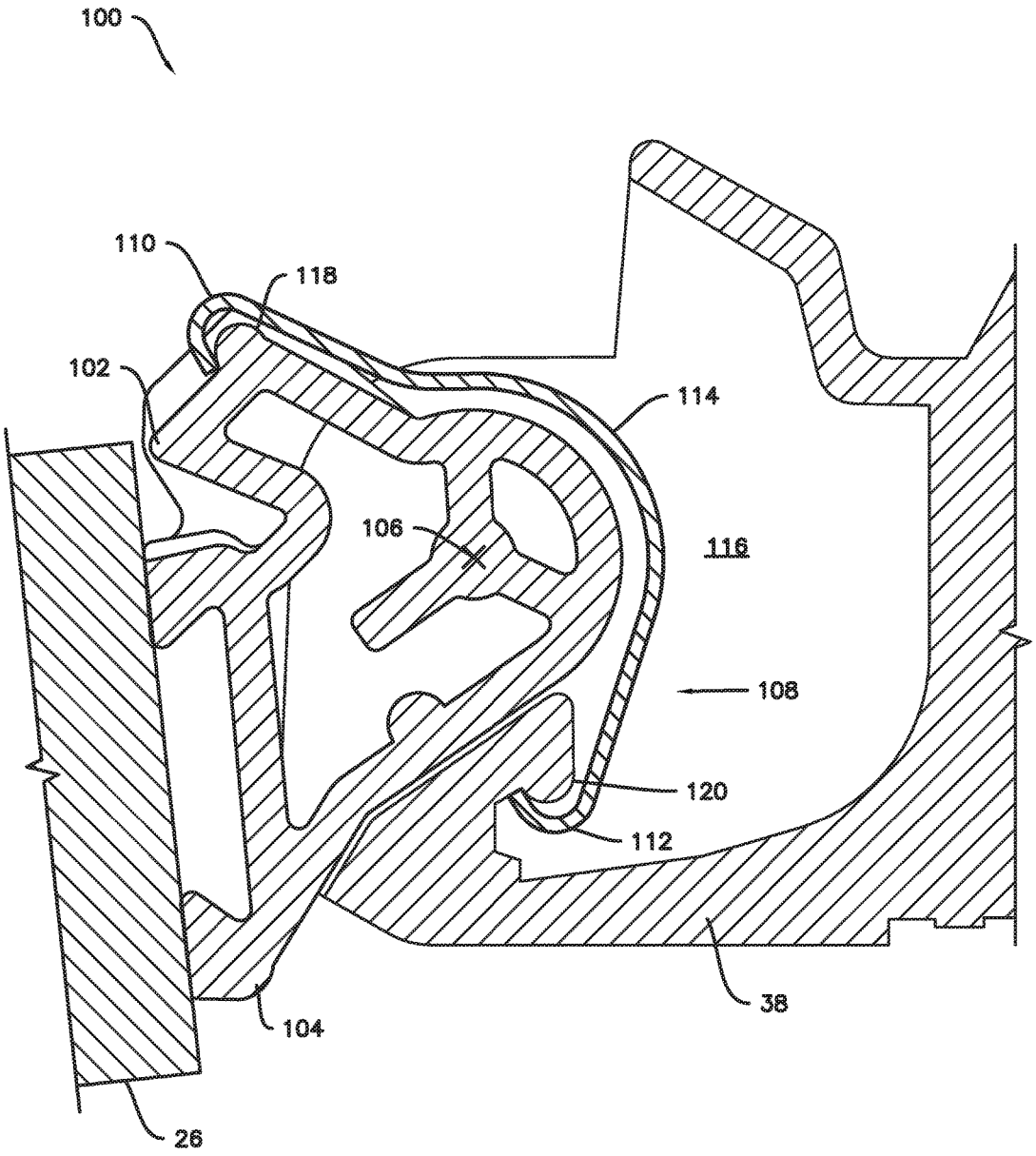
FIG. 5 provides a sectional view of a hinge and an articulating mullion according to an exemplary embodiment of the present disclosure in a first position.
Figure 6:
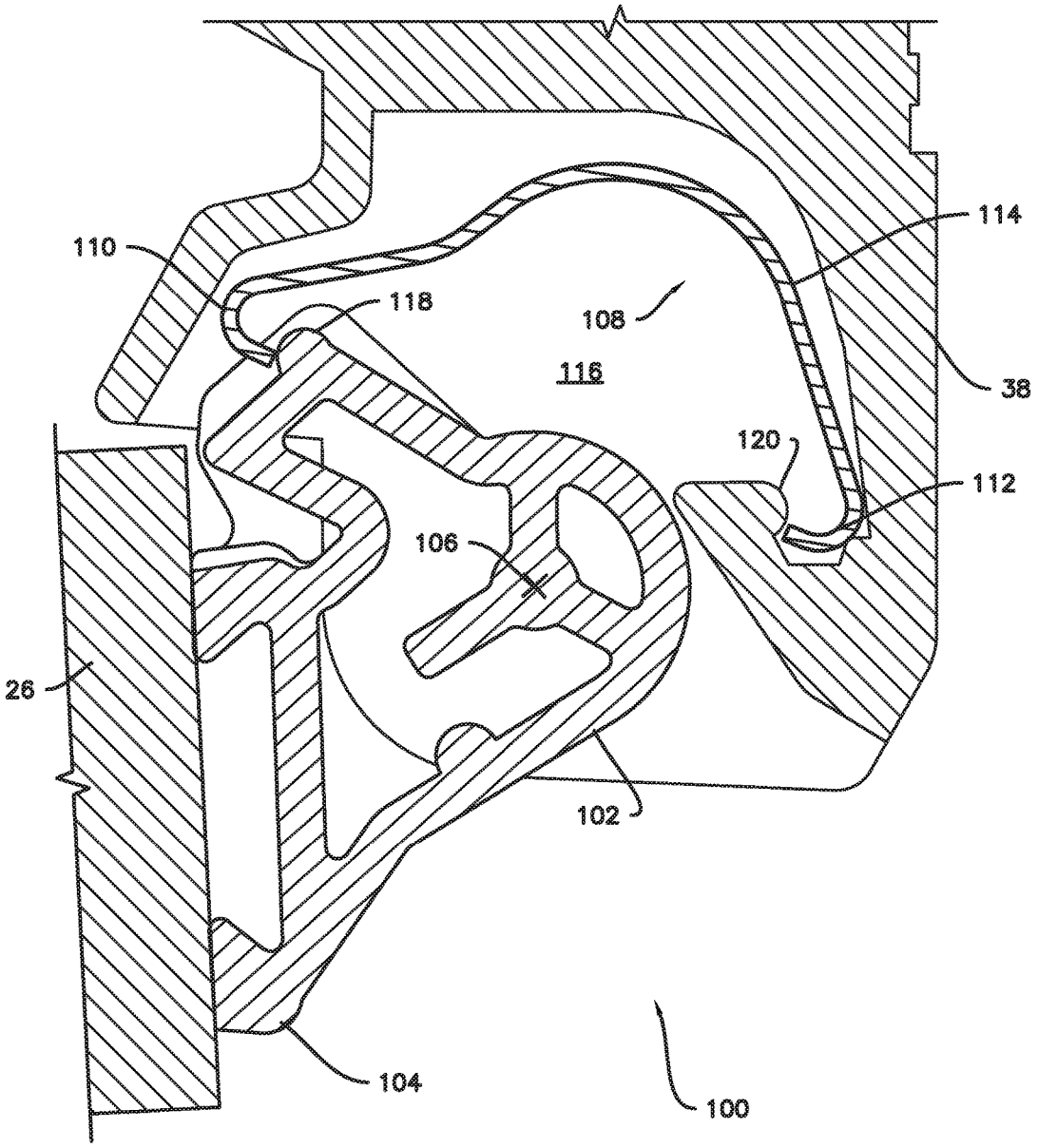
FIG. 6 provides a sectional view of then hinge and articulating mullion of FIG. 5 in a second position.
Figure 7:
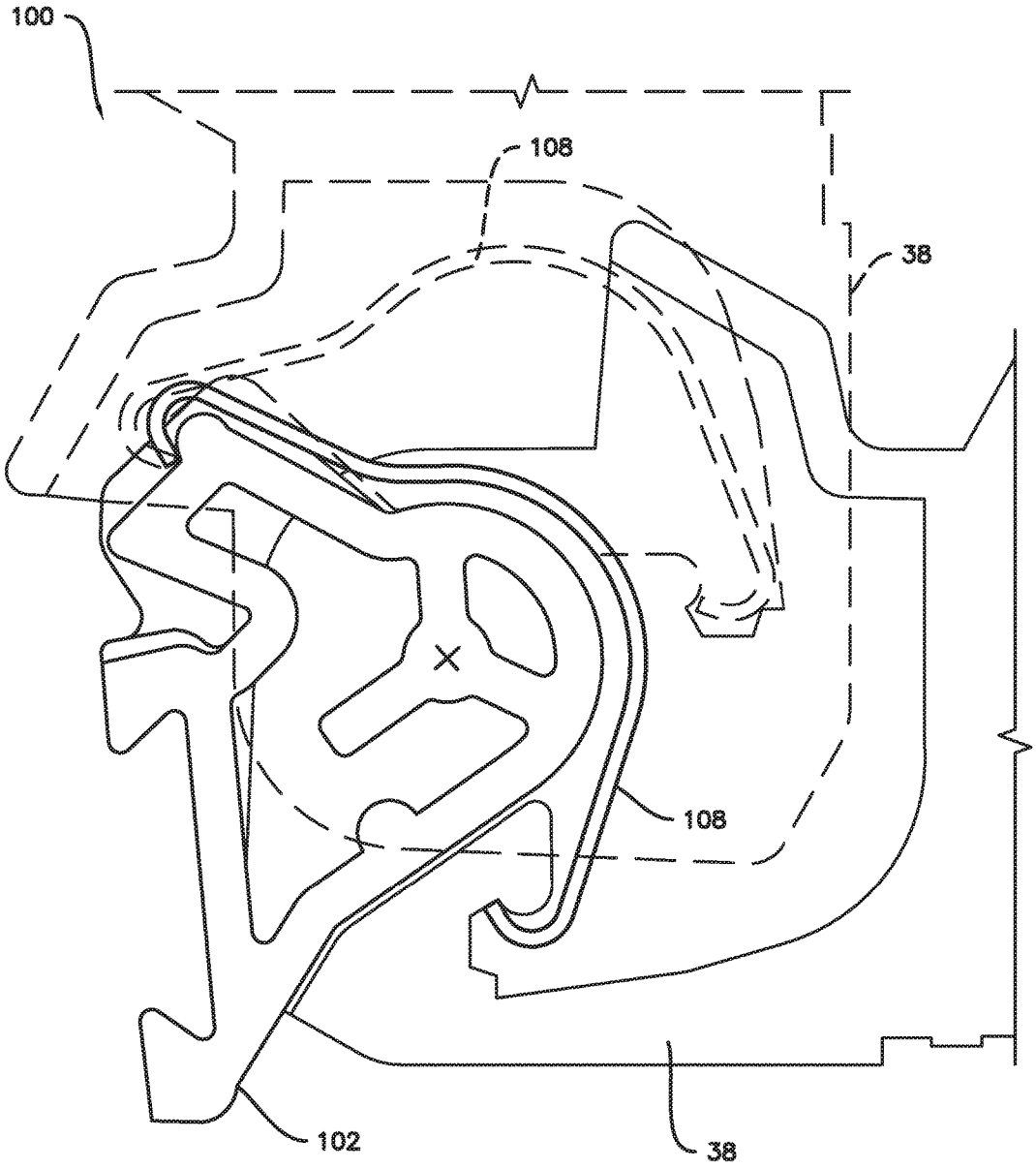
FIG. 7 illustrates a range of motion of the exemplary mullion of FIGS. 5 and 6 between the first position and the second position.

FIGS. 5 through 7 illustrate a section view of an example embodiment of the hinge 100 connecting mullion 38 to door 26. As shown, the hinge 100 may include a pivot member 102 and a biasing element, which in this embodiment is a clip spring 108. As noted above, the mullion 38 may be rotatable between a first position and a second position. In some embodiments, the first position of the mullion 38 may correspond to the closed position of the door 26 and the second position of the mullion 38 may correspond to the open position of the door 26. Further, the biasing element, e.g., in this embodiment, clip spring 108, may be configured to retain the mullion 38 in the first position and the second position. For example, the clip spring 108 may provide tension to hold the articulating mullion 38 at its rotational end limits in either the open position of the door 26 (e.g., second position of FIG. 6) or the closed position of the door 26 (e.g., first position of FIG. 5). The clip spring 108 may be disposed in an equilibrium position in the first position and in the second position. The clip spring 108 may provide tension to pull and hold the articulating mullion 38 to its rotational end limits, e.g., at the first position and the second position. As best seen in FIG. 7, the mullion 38 travels through approximately 90° of rotation between the first position and the second position. Thus, in some embodiments, the mullion 38 may be substantially parallel to the door 26 in the first position (e.g., closed door position) and the mullion 38 may form an angle of about ninety degrees with the door 26 in the second position (e.g., open door position). As used herein, terms of approximation, such as "generally," or "about" include values within ten percent greater or less than the stated value.

As shown in FIGS. 5 and 6, the pivot member 102 may include a hinge plate 104, which may be coupled or secured to refrigerator door 26. In other embodiments, the hinge plate 104 may be coupled or secured to another door 28, 30, or 32, or to a structural wall 55 defined on an inner surface of one of the doors 26, 28, 30, or 32.

As may be seen, e.g., in FIG. 5, the clip spring 108 may include a first hook 110 at a first end, a second hook at 112 a second end opposite the first end, and an arcuate portion 114 extending between the first hook 110 and the second hook 112. The pivot member 102 may define an axis of rotation R (FIG. 3), and the axis of rotation R passes through a pivot point 106 of the pivot member 102. As the mullion 38 rotates, the pivot member 102 passes between the hooks 110 and 112. As such, the pivot point 106 is positioned between the first hook 110 and the second hook 112 of the clip spring 105 and proximate the arcuate portion 114 of the clip spring 108 in the first position, e.g., the closed-door position as shown in FIG. 5, and the pivot point 106 is positioned outside of the clip spring 108 in the second position, e.g., the open-door position as shown in FIG. 6. When the pivot member 102 passes between the hooks 110 and 112, the direction of torque transfer from the clip spring 108 reverses. This embodiment may also include a clearance space 116 defined within the mullion 38 to allow for the travel of the clip spring 108, e.g., the clearance space 116 may be sized and shaped to accommodate the movement of the clip spring 108. As shown, the clip spring 108 partially encircles the pivot member 102 in the first position (FIG. 5) and the clip spring 108 extends into the clearance space 116 in the second position (FIG. 6). Further movement in the counter-clockwise direction, e.g., beyond the second position of FIG. 6 may be prevented by some mechanical means, such as the mullion 38 striking a bumper elsewhere in the system thereby inhibiting further rotation.

As may be seen, e.g., in FIGS. 5 and 6, the first hook 110 of the spring clip 108 may be secured to the pivot member 102 and the second hook 112 of the spring clip 108 may be secured to the mullion 38. For example, the first hook 110 of the clip spring 108 may be secured to the pivot member 102 at a contact point 118, e.g., defined on a first lip as shown in FIG. 5, and the second hook 112 of the clip spring 108 may be secured to the mullion 38 at a second lip 120. When the clip spring 108 is thereby hooked onto the mullion 38 and the pivot member 102, the clip spring 108 has an inward tension between hooks 110 and 112. As best seen in FIG. 7, the clip spring 108 rotates around the pivot member 102 at the contact point 118 as the mullion 38 rotates between the first position and the second position. As the clip spring 108 rotates, the clip spring 108 will deform or stretch to accommodate that rotation, such that when the clip spring 108 is in an in-between position (between the closed-door and open-door positions shown in FIGS. 5 and 6), the inward force of the clip spring 108 is greater than in the equilibrium position (e.g., first or second position). Thus, the clip spring 108 acts as a biasing element due to the inward force tending to drive the clip spring 108 into one of the positions shown, either the first position of FIG. 5 or the second position of FIG. 6. Accordingly, the clip spring 108 is an example embodiment of a biasing element configured to retain the mullion 38 in the first position and the second position.

The clip spring 108 experiences its greatest inward force when the clip spring 108 is stretched the furthest, i.e., when the hooks 110 and 112 are stretched to their furthest distance from each other. This occurs at the time when the pivot point 106 of the pivot member 102 passes between the hooks 110 and 112. As the mullion 38 rotates from the first position shown in FIG. 5 towards such "crossing over" point, the tension in the clip spring 108 creates a force that biases the mullion 38 back towards the first position. Once the clip spring 108 passes the crossing over point, the tension begins to lessen again, and the tension in the clip spring 108 creates a biasing force that pushes the mullion 38 further towards the second position depicted in FIG. 6. Thus, the clip spring 108 switches from pushing the mullion 38 in a clockwise direction to a counter-clockwise direction. The counter-clockwise force on the mullion 38 results from the second hook 112 pulling on the second lip 120 of the mullion 38.

It should be understood that in refrigerator embodiments that include a mullion biasing element, e.g., groove 43 and/or 37 as described above and shown in FIG. 2, to move the mullion 38 or 40 between the first position and the second position, the transition from the open-door position to the closed-door position occurs while the mullion tab 39 or 41 (FIG. 2) is sliding into the track of the groove 37 or 43. Once the hinge 100 passes the crossing over point, the force of the hinge 100 helps to hold the door 26 closed. When opening the door 26, a user must overcome the initial force holding the door 26 in the closed position and the mullion 38 or 40 in the closed-door position. But as the mullion tab 39 or 41 begins to slide out of the track of the groove 37 or 43, the force of the clip spring 108 reverses directions, helping the mullion 38 or 40 to rotate to the second position (e.g., open door position).

Figure 8:
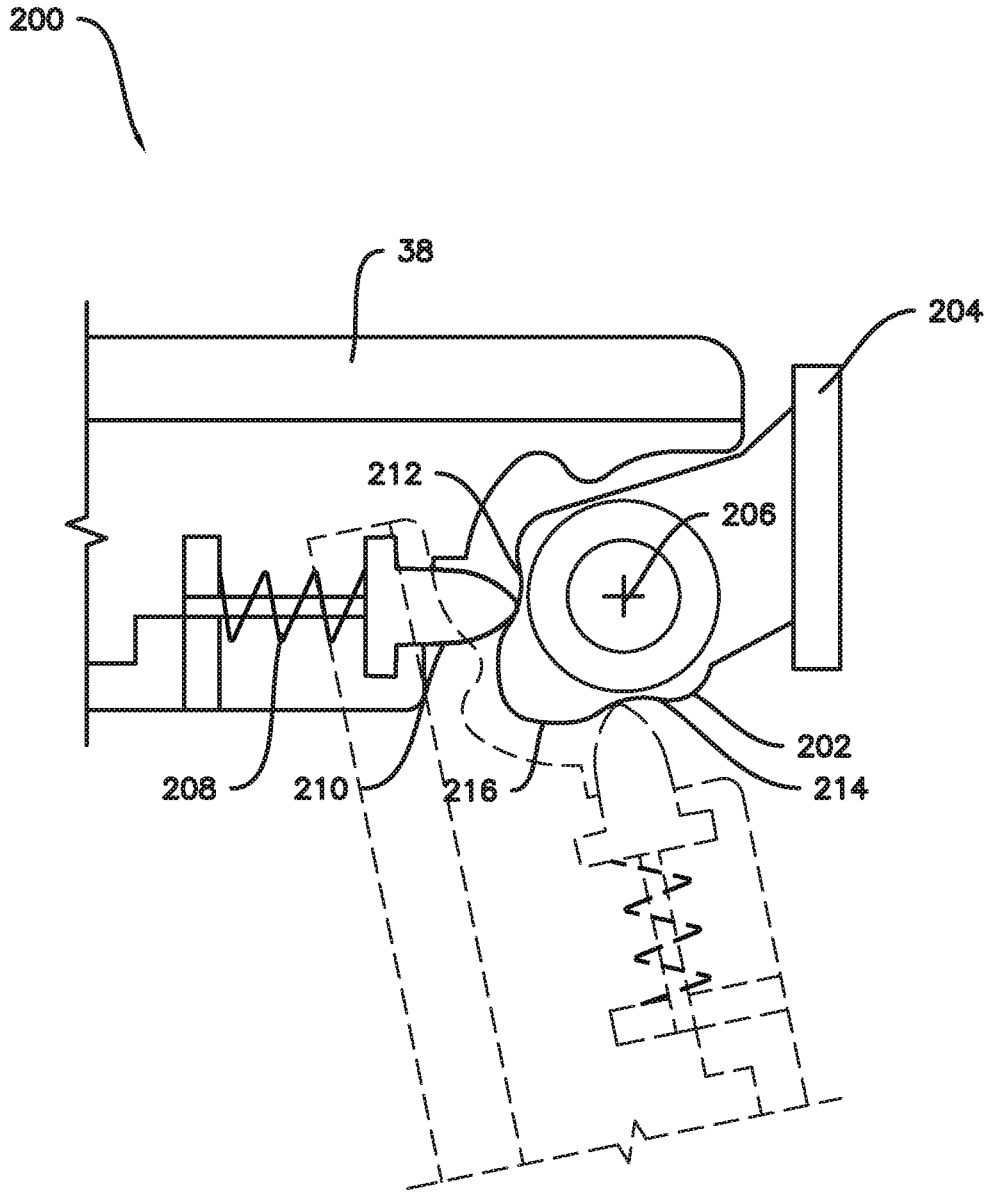
FIG. 8 provides a sectional view of a hinge and an articulating mullion according to another exemplary embodiment of the present disclosure.

FIG. 8 provides a sectional view of a hinge 200 and an articulating mullion 38 according to another exemplary embodiment of the present disclosure. The hinge 200 in this example includes a pivot member 202 and a biasing element, which in this example is a coil spring 208 in operative communication with a plunger 210. The plunger 210 may be built into the articulating mullion 38. The coil spring 208 may bias the plunger 210 into contact with the pivot member 202. Similar to the example hinge 100 described above, the mullion 38 may be rotatable between a first position (shown in solid lines in FIG. 8) and a second position (shown in dashed lines in FIG. 8), and the hinge 200 may be secured or coupled to, e.g., one of the doors 26, 28, 30, or 32, e.g., via a hinge plate 204.

As shown in FIG. 8, the coil spring 208 may be in an equilibrium position in the first position and in the second position. The pivot member 202 may include a first detent 212 and a second detent 214. The plunger 210 may engage the first detent 212 in the first position and the second detent 214 in the second position. The coil spring 208 may be configured to bias the plunger 210 towards the first detent 212 when the mullion 38 is in the first position and configured to bias the plunger 210 towards the second detent 214 when the mullion 38 is in the second position. Accordingly, where the engagement of the plunger 210 with one of the detents 210 or 212 permits coil spring 208 to extend to its equilibrium position, the coil spring 208 may be in an equilibrium position in the first position and in the second position and the coil spring 208 will provide some resistance to movement away from the first position or the second position. Thus, the coil spring 208 is an example embodiment of a biasing element configured to retain the mullion 38 in the first position and the second position.

The pivot member 202 may include a ramp 216 between the first detent 212 and the second detent 214. The biasing force of coil spring 208 on the plunger 210 is oriented towards a pivot point 206, such that the coil spring 208 imparts a hinging force on the mullion 38, which may cause the mullion 38 to hinge until the plunger 210 settles into one of the detents 212 or 214. When the mullion 38 rotates from the first position to the second position (represented in dashed lines in FIG. 8), the plunger 210 travels over the ramp 216, during which time the biasing force of coil spring 208 increases. The ramp 216 is sloped so that the plunger 210 is directed into one of the detents 212 or 214. Due to the slope, the plunger 210 tends not to remain in an intermediate position (e.g., between the open door position and the closed door position) without an external force applied.

In the illustrated example embodiments, the first position corresponds to an open door position and the second position corresponds to a closed door position. However, in other embodiments, the first position may correspond to a closed door position and the second position may correspond to an open door position. For example, in various embodiments the pivot member 102 or 202, the mullion 38 and the refrigerator door 26 may be configured such that the positions as shown are reversed, e.g., by changing the orientation of the hinge plate 104 or 204. The embodiments shown here are by way of example only and a person of ordinary skill in the art would understand that the concepts illustrated could be rearranged into different configurations to achieve the desired result of an articulated mullion that can be secured in two or more positions, related to opening and closing a door of a refrigerator. Additionally, in various embodiments, the refrigerator appliance may include a pair of French doors at either or both of the fresh food chamber and the frozen food chamber and any door of the French doors may include an articulating mullion according to any of the various embodiments described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a chamber;

a door coupled to the cabinet and rotatable between a closed position and an open position to selectively sealingly enclose the chamber; and a mullion rotatably coupled to the door via a hinge, the mullion rotatable between a first position and a second position, the hinge comprising a pivot member and a clip spring configured to retain the mullion in the first position and the second position, the clip spring disposed in an equilibrium position in the first position and in the second position, the clip spring comprising a first hook at a first end, a second hook at a second end, and an arcuate portion extending between the first hook and the second hook, the first hook of the clip spring secured to a first lip on the pivot member, the second hook of the clip spring secured to a second lip on the mullion, the pivot member defining an axis of rotation which passes through a pivot point of the pivot member, the pivot point positioned between the first hook and the second hook of the clip spring and proximate the arcuate portion of the clip spring in the first position, and the pivot point positioned outside of the clip spring in the second position;

wherein the clip spring rotates around the pivot member at the first lip as the mullion rotates between the first position and the second position, and wherein the mullion forms an angle of about ninety degrees with the door in the second position and the mullion is substantially parallel to the door in the first position.

2. The refrigerator appliance of claim 1, wherein the first position of the mullion corresponds to the closed position of the door and the second position of the mullion corresponds to the open position of the door.

3. The refrigerator appliance of claim 1, wherein the pivot member further comprises a hinge plate coupled to the door.

4. The refrigerator appliance of claim 1, wherein the mullion further comprises a clearance space, and wherein the clip spring partially encircles the pivot member in the first position and the clip spring extends into the clearance space in the second position.

5. The refrigerator appliance of claim 1, further comprising a groove defined in the cabinet, wherein the mullion comprises a tab, the groove of the cabinet configured to engage the tab of the mullion such that the mullion rotates between the first position and the second position when the door is rotated between the closed position and the open position.

6. The refrigerator appliance of claim 1, further comprising a structural wall defined on an inner surface of the door, wherein the pivot member further comprises a hinge plate coupled to the structural wall.

7. The refrigerator appliance of claim 1, wherein the chamber is a fresh food storage chamber, the refrigerator further comprises a frozen food storage chamber defined in the cabinet, a freezer door rotatably hinged to the cabinet for accessing the frozen food storage chamber, and a freezer mullion rotatably coupled to the freezer door via a freezer mullion hinge, the freezer mullion rotatable between a first position and a second position, the freezer mullion hinge comprising a freezer mullion pivot member and a freezer mullion biasing element configured to retain the freezer mullion in the first position and the second position.

8. The refrigerator appliance of claim 7, wherein the freezer mullion biasing element comprises a freezer mullion clip spring, the freezer mullion clip spring disposed on the freezer mullion pivot member in an equilibrium position in the first position and in the second position.

* * * * *